US007372042B2

(12) United States Patent
Mordehai et al.

(10) Patent No.: US 7,372,042 B2
(45) Date of Patent: May 13, 2008

(54) LENS DEVICE FOR INTRODUCING A SECOND ION BEAM INTO A PRIMARY ION PATH

(75) Inventors: Alexander Mordehai, Loveland, CO (US); Gangqiang Li, Loveland, CO (US); Stuart C. Hansen, Loveland, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 287 days.

(21) Appl. No.: 11/217,248

(22) Filed: Aug. 31, 2005

(65) Prior Publication Data

US 2007/0045531 A1 Mar. 1, 2007

(51) Int. Cl.
*H01J 49/00* (2006.01)

(52) U.S. Cl. ..... 250/396 R; 250/285

(58) Field of Classification Search ..... 250/285, 250/288, 281, 282, 396 R
See application file for complete search history.

(56) References Cited

U.S. PATENT DOCUMENTS

| | | | | |
|---|---|---|---|---|
| 5,668,373 | A * | 9/1997 | Robbat et al. | 250/339.12 |
| 6,027,890 | A | 2/2000 | Ness et al. | |
| 6,469,297 | B1 * | 10/2002 | Kato | 250/288 |
| 6,596,989 | B2 | 7/2003 | Kato | |
| 6,737,641 | B2 * | 5/2004 | Kato | 250/281 |
| 2003/0141449 | A1 | 7/2003 | Wells et al. | |
| 2004/0108455 | A1 | 6/2004 | Mordehai | |

* cited by examiner

*Primary Examiner*—Kiet T. Nguyen

(57) ABSTRACT

The invention provides a device for introducing ions into the primary ion path of a mass spectrometry system. In general, the device contains an electrical lens having a primary ion passageway and a secondary ion passageway that merges with the primary ion passageway. In certain embodiments, the electrical lens contains a first part and a second part that, together, form the primary ion passageway. The first part of the lens may contain the secondary ion passageway.

32 Claims, 6 Drawing Sheets

LENS DEVICE FOR INTRODUCING A SECOND ION BEAM INTO A PRIMARY ION PATH

BACKGROUND

Mass spectrometry is an analytical methodology used for quantitative molecular analysis of analytes in a sample. Analytes in a sample are ionized, separated according to their mass by a spectrometer and detected to produce a mass spectrum. The mass spectrum provides information about the masses and in some cases the quantities of the various analytes that make up the sample. In particular embodiments, mass spectrometry can be used to determine the molecular weight or the molecular structure of an analyte in a sample. Because mass spectrometry is fast, specific and sensitive, mass spectrometer devices have been widely used for the rapid identification and characterization of biological analytes.

Mass spectrometers may be configured in many different ways, but are generally distinguishable by the ionization methods employed and the ion separation methods employed. For example, in certain devices parent analyte ions are isolated, the parent ions are fragmented to produce daughter ions and the daughter ions are subjected to mass analysis. The identity and/or structure of the parent analyte ion can be deduced from the masses of the daughter ions. Such devices, generally referred to as tandem mass spectrometers (or MS/MS devices) may be coupled with a liquid chromatography system (e.g., an HPLC system or the like) and a suitable ion source (e.g. an electrospray ion source) to investigate analytes in a liquid sample.

In a mass spectrometer, analyte molecules are ionized in an ion source. The masses of the resultant ions are determined in a vacuum by a mass analyzer that measures the mass/charge (m/z) ratio of the ions. When used in conjunction with a liquid chromatography device, a mass spectrometer can provide information on the molecular weight and chemical structure of compounds separated by the chromatography device, allowing identification of those components.

Mass spectrometer systems generally contain a primary ion path down which ions are transported from a primary ion source (e.g., a source of analyte ions) to a mass spectrometer. In many instances it is desirable to controllably introduce ions produced by a second ion source into the primary ion path. For example, in certain embodiments it is sometimes desirable to introduce ions of known mass and charge, so called "calibration standards", "reference mass standards" or "internal standards", into an ion stream containing analyte ions of interest in order to provide a more accurate measurement of the molecular mass of those analytes. In addition, it is sometimes desirable to be able to analyze ions produced by two distinct ion sources in the same mass spectrometer, either simultaneously or in series, without having to disconnect and reconnect any apparatus. Further, it is sometimes desirable to introduce additional ions into a primary ion path in order that the additional ions collide with the primary ions to physically or chemically change (e.g., change the charge of, reduce the energy of, or fragment) the ions in the primary ion path.

Various systems for introducing a second ion beam into a primary ion path in a mass spectrometer are known. For example, a "Y"-shaped sampling device may be used to combine different ions as they exit an ion source (see, e.g., Smith et al J. Mass. Spec. Rev. 1991 10: 359-451), a quadrupole ion deflector may be used to direct ion streams into a common ion guide (see, e.g., U.S. Pat. No. 6,596,989), and ion beams may be introduced into opposite sides of a linear ion trap and are combined within the trap (see, e.g., Syka et al, Proc. Natl. Acad. Sci. 2004 101:9528-9533). However, these systems generally lack flexibility, are impractical for many purposes, or greatly decrease the sensitivity of the ion detection for the primary ions.

Accordingly, a need exists for new means for introducing a secondary ion stream into a primary ion path. This invention meets this need, and others.

SUMMARY OF THE INVENTION

The invention provides a device for introducing a second ion beam into the primary ion path of a mass spectrometry system. In general, the device contains an electrical lens having a primary ion passageway and a secondary ion passageway that merges with the primary ion passageway. In certain embodiments, the electrical lens contains a first part and a second part that, together, form the primary ion passageway. The first part of the lens may contain the secondary ion passageway. A device for delivering ions to a mass analyzer and a mass spectrometer system containing the subject electric lens are also provided. Also provided by the invention are methods for introducing a second ion beam into a primary ion path using the subject electric lens, and methods of sample analysis. The invention finds use in a variety of analytical methods. For example, the invention finds use in chemical, environmental, forensic, food, pharmaceutical and biological research applications.

DETAILED DESCRIPTION OF THE INVENTION

The invention provides a device for introducing a second ion beam into the primary ion path of a mass spectrometry system. In general, the device contains an electrical lens having a primary ion passageway and a secondary ion passageway that merges with the primary ion passageway. In certain embodiments, the electrical lens contains a first part and a second part that, together, form the primary ion passageway. The first part of the lens may contain the secondary ion passageway. A device for delivering ions to a mass analyzer and a mass spectrometer system containing the subject electric lens are also provided. Also provided by the invention are methods for introducing a second ion beam into a primary ion path using the subject electric lens, and methods of sample analysis. The invention finds use in a variety of analytical methods. For example, the invention finds use in chemical, environmental, forensic, food, pharmaceutical and biological research applications.

Methods recited herein may be carried out in any logically possible order, as well as the recited order of events. Furthermore, where a range of values is provided, it is understood that every intervening value, between the upper and lower limit of that range and any other stated or intervening value in that stated range is encompassed within the invention.

The referenced items are provided solely for their disclosure prior to the filing date of the present application. Nothing herein is to be construed as an admission that the present invention is not entitled to antedate such material by virtue of prior invention.

Reference to a singular item, includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

The term "primary ion path" is used herein to indicate the path of ions produced by a primary ion source in mass spectrometer system. Generally, the primary ion path of a mass spectrometer system extends from a primary ion source to a mass spectrometer though any number of well known devices, e.g., skimmers, intermediate vacuum chambers, lenses, ion guides, ion traps, ion filters, collision cells, etc., that are in between the primary ion source and the mass spectrometer. A primary ion path need not contain any ions.

Figure 1:
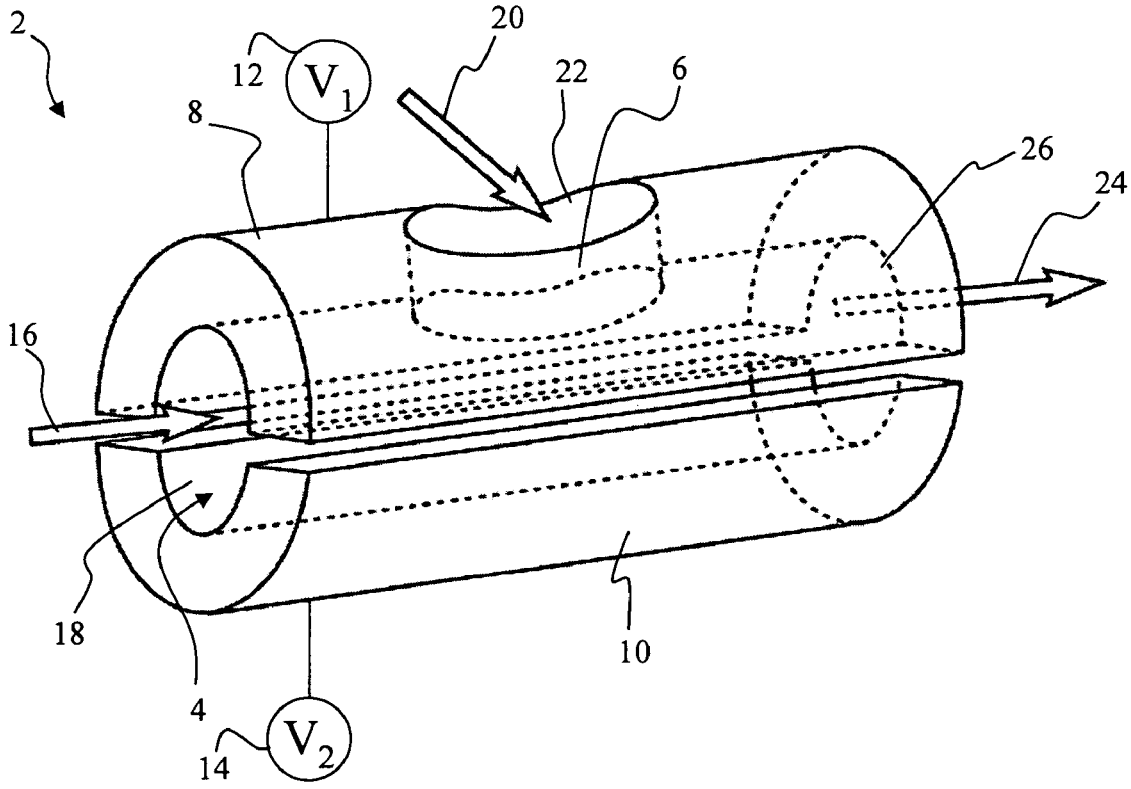
FIG. 1 is a schematic representation of a first representative embodiment of a subject device.

The term "primary ion passageway", as will be described in greater detail below, is used herein to indicate a passageway that extends through a subject electric lens device. When employed in a mass spectrometry system and as illustrated in FIG. 1, the primary in passageway of a subject electric lens device forms part of the primary ion path of the mass spectrometry system.

The terms "second ion beam" and "secondary ion stream" are used herein interchangeably to indicate the ions that are produced by an ion source that is distinct from the primary ion source. A second ion beam enters a subject electrical lens via its secondary ion passageway. The ion cloud that forms a "second ion beam" or "secondary ion stream" may be of any shape, and may be traveling in any direction.

The term "lens" refers to any lens or electrode connected to a power supply to guide or direct ion motion. The term may be interpreted to include several electrodes connected to power supplies.

Further definitions may occur throughout the description set forth below.

As mentioned above, the invention provides a device for introducing a second ion beam into a primary ion path of a mass spectrometry system. The general features of the instant device are set forth in FIG. 1. With reference to FIG. 1 and in general terms, an instant device 2 is an electrical lens containing a primary ion passageway 4 that forms part of the primary ion path of a mass spectrometer, and a secondary ion passageway 6. The secondary ion passageway merges with the primary ion passageway within the device. In certain embodiments, the electrical lens contains a first part 8 and a second part 10 that, together, form (i.e., define) the primary ion passageway 4. The first part 8 may contain the secondary ion passageway 6. The first part may be connected to a first DC power supply 12 and the second part may be connected to a second DC power supply 14. The primary ion path of a mass spectrometry system, as indicated by arrow 16, enters the ion entrance 18 of the primary ion passageway, extends through the primary ion passageway 4, and exits the primary ion passageway at the ion exit 26. During operation of the subject electrical lens, a secondary ion stream, indicated by arrow 20, enters the ion entrance of the secondary ion passageway 22 and travels through the secondary ion passageway 6. The secondary ion stream is introduced into the primary ion path within the device and the second ion beam 24 exits the device through the ion exit 26. By applying differential voltage potentials to the first part 8 and the second part 10 by power supplies 12 and 14, respectively, the secondion stream passes through the secondary ion passageway, changes direction, and merges with the primary ion path within the device. Since the lens described herein contains two parts that define the primary ion passageway, the instant lens, in certain embodiments, may be referred to as a split lens.

The subject device may be made from a conductive material, e.g., a metal such as stainless steel or the like. As illustrated in FIG. 1, the first and second parts may be spaced from each other. In certain embodiments, the first part and the second part of the subject electrical lens may be electrically insulated from each other. The first and second parts may be spaced from each other by the electrical insulator. In certain embodiments, the electrical insulator connects the first part to the second part. As illustrated in FIG. 1, the primary and secondary ion passageways are generally cylindrical (except for where the passageways merge), although this may not always be the case. In particular embodiments, the central axis of the secondary ion passageway may be at any angle (e.g., about 15° to about 30°, 30° to about 45°, 45° to about 60°, 60° to about 85° or 85° to about 90°) relative to the central axis of the primary ion passageway. FIG. 1 illustrates a representative embodiment in which the central axis of the secondary ion passageway is at 45° with respect to the central axis of the primary ion passageway.

Figure 2:
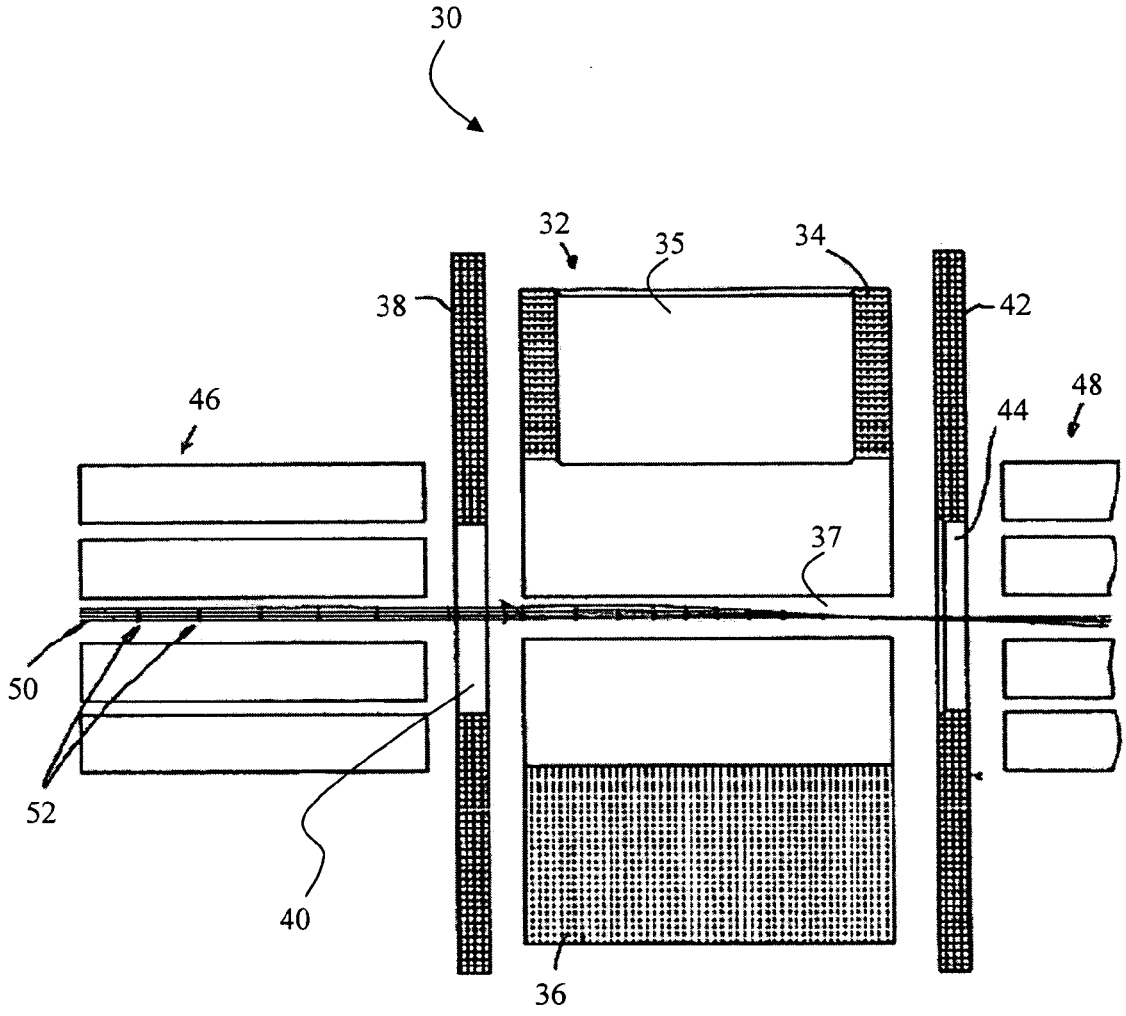
FIG. 2 is a schematic representation of a second representative embodiment of a subject device operated in the "off" mode. Simulated trajectories of a primary ion beam passing through the primary ion passageway are shown.

The subject device is dimensioned for employment in a mass spectrometer, particularly, but not always, in between two radio frequency (RF) multipole ion guides. Accordingly, the size of a subject device may vary greatly. In representative embodiments, a subject device may be about 0.2 cm to about 10 cm (e.g., about 0.5 cm to about 5 cm or 2 cm to 3 cm) in length, and about 0.2 cm to about 5 cm (e.g., about 1 cm to about 3 cm) in height. The internal diameter of the primary and secondary ion passageways may also vary. In representative embodiments, the internal diameter of either of the ion passageways may be 0.1 cm to about 4 cm, e.g., about 0.3 cm to 2 cm or about 0.5 cm to about 1 cm In certain embodiments, a subject electrical lens may further contain at least one (e.g., one, two or three or more) ion stream focusing element, e.g., at least one electrical element adapted for focusing a stream of ions into a collimated beam. If employed, an ion stream focusing element may be at the entrance of the primary ion passageway, at the exit of the primary ion passageway, and/or at the entrance of the secondary ion passageway. For example and as illustrated in FIG. 2, a subject device may contain an ion stream focusing element 38 at the ion entrance and an ion stream focusing element 42 at the ion exit of the primary ion passageway. Such ion stream focusing elements generally include an focusing lens connected to a power supply, although other elements may be employed. Ion focusing lenses, particularly ion lenses that are ring electrodes (i.e., lenses that contain one or more ring shaped electrodes), are generally well known in the art.

In certain embodiments and in accordance with the above, the invention also provides a device for delivering ions to a mass analyzer. This ion delivery device contains an electrical lens, as described above, and further contains multipole devices at the ion entrance and ion exit ends of the primary ion passageway. Accordingly, a subject ion delivery device may contain an electrical lens containing a primary ion passageway and a secondary ion passageway that merges with the primary ion passageway, a first multipole device at the ion entrance end of the primary ion passageway, and a second multipole device at the ion exit end of the primary ion passageway. The electric lens and multipole devices are generally operably connected so that ions can pass from the first multipole device to into the primary ion passageway and then into the second multipole device during operation of the ion delivery device. As would be apparent from the above and as illustrated in FIG. 2, a subject ion delivery device may further contain ion stream focusing elements 38 and 42 at the ion entrance and ion exit of the primary ion passageway, between the ends of the primary ion passageway-of a subject lens and the multipole elements of the subject ion delivery device.

The multipole devices employed in a subject ion delivery device may be any type of multipole device that can manipulate (for example, move, e.g., transport, or fragment, store, filter, cool, etc.) ions in a mass spectrometer system. The term "multipole device" is used herein to encompass quadrupole, hexapole, octopole, and decapole devices (or similar devices containing other numbers of elongated electrodes), regardless of how those devices may be employed. In one embodiment, the multipole device is a collision cell in which ions are collided with charged particles to facilitate charge reduction, charge transfer, ion-ion reactions, electron capture dissociation, collisional cooling, fragmentation or another physical or chemical process. In another embodiment, the multipole device is an ion guide for transporting ions from one place to another. An ion trap (including a two-dimensional and three-dimensional ion trap as well as linear and non-linear ion traps) may be employed in a collision cell in many embodiments of the invention.

A subject multipole device may contain a plurality of rods (i.e., 2 or more rods, typically an even number of rods, e.g., 4, 6, 8 or 10 or more rods), longitudinally arranged around a central axis along which ions may be maintained (e.g., trapped) or directionally moved (i.e., from the ion entrance end of the device to an ion exit end of the device) during operation of the device. The term "rod" is used herein to describe a composition that has any cross-sectional shape, e.g., a cross sectional shape that is circular, oval, semicircular, concave, flat, square, rectangular, hyperbolic, or multisided. Hyperbolic rods are most frequently employed in an ion trap, although any type of rod may be used.

In general, the rods are of a subject multipole device are conductive, and are arranged to provide an ion entrance for accepting ions, an ion exit for ejecting ions, and an ion passageway having a central axis extending from the ion entrance end to the ion exit end. In certain embodiments, the rods may be held in a suitable arrangement by one or more collars, although several alternatives to collars may also be used.

The spacing between consecutive rods is usually the same between all rods of a device, although rod spacing may vary between different devices. In use, the rods are electrically connected so as to provide an alternating radio frequency (RF) field that confines the ions to a region proximal to the ion passageway, and, in certain embodiments, direct current (DC) electric fields that prevent ions from exiting the device from the ends of the device.

A subject multipole device may be segmented or unsegmented, and may contain other optical components for maintaining ions within the multipole device. In one embodiment, a multipole device is an ion trap containing substantially hyperbolic rods and is segmented into three sections that are independently connected to different power sources. In an alternative embodiment, a multipole device is an ion trap containing hyperbolic rods and is not segmented. Such a device may contain lenses that form apertured electrode "caps" over the ends of the device to regulate (e.g., prevent or allow) ions from escaping from the central passageway of the multipole device.

In certain embodiments, a DC voltage is applied to the ends of the multipole device (either to the apertured electrode caps or the terminal rod sections, for example, depending on which type of multipole device is used) to prevent ions from exiting the multipole device from the ion entrance and ion exit, and an RF voltage is applied to the rods to generate an RF field that confines the ions within the device. As is known for multipole devices, the RF voltages supplied to every second rod may be 180 degrees out of phase with that supplied to the even numbered rods. In general, an ion-confining RF produced in the multipole device typically has a frequency of 0.1 MHz to 10 MHz, e.g., 0.5 MHz to 5 MHz, and a magnitude of 10V to 10,000V peak-to-peak, e.g., 400V to 800V peak to peak Exemplary multipole devices, including ion guides and linear ion traps, that may be employed herein are generally well known in the art (see, e.g., U.S. Pat. Nos. 6,570,153, 6,285,027 and published patent application 20030183759, which publications are incorporated by reference in their entirety). In alternative embodiments, an RF ion funnel or tube (see, e.g., U.S. Pat. Nos. 6,107,628 and 6,642,514) may be employed.

In one representative embodiment, the first and second multipole devices employed in a subject ion delivery device are both employed as an ion guides. In another representative embodiment, the first multipole device is employed as an ion guide and the second multipole device is employed as an ion trap/collision cell. In a further representative embodiment, the first multipole device is employed as a mass filter (i.e., a filter that selects ions of a particular mass) and the second multipole device is employed as an ion trap/collision cell. Other configurations adequately represented by the above representative embodiments would be readily apparent to one of skill in the art in view of the above.

While not essential, a subject ion delivery device may further contain a third multipole device and/or an ion stream focusing device operably connected to the secondary ion passageway, for directing the second ion beam towards the ion entrance of the secondary ion passageway.

In use of a subject electrical lens, the second ion beam is generally directed into the secondary ion passageway at an angle in the range of about 5° to about 85°, e.g., in the range of about 5° to about 15°, about 15° to about 30°, about 30° to about 45°, about 45° to about 60° or about 60° to about 85°, relative to a central axis of the secondary ion passageway. In one exemplary embodiment illustrated in FIG. 3, the ions of the second ion beam may be directed into the secondary ion passageway at an angle of about 45°, although any angle listed above, particularly in the range of 30° and 60°, is readily employed.

Figure 3:
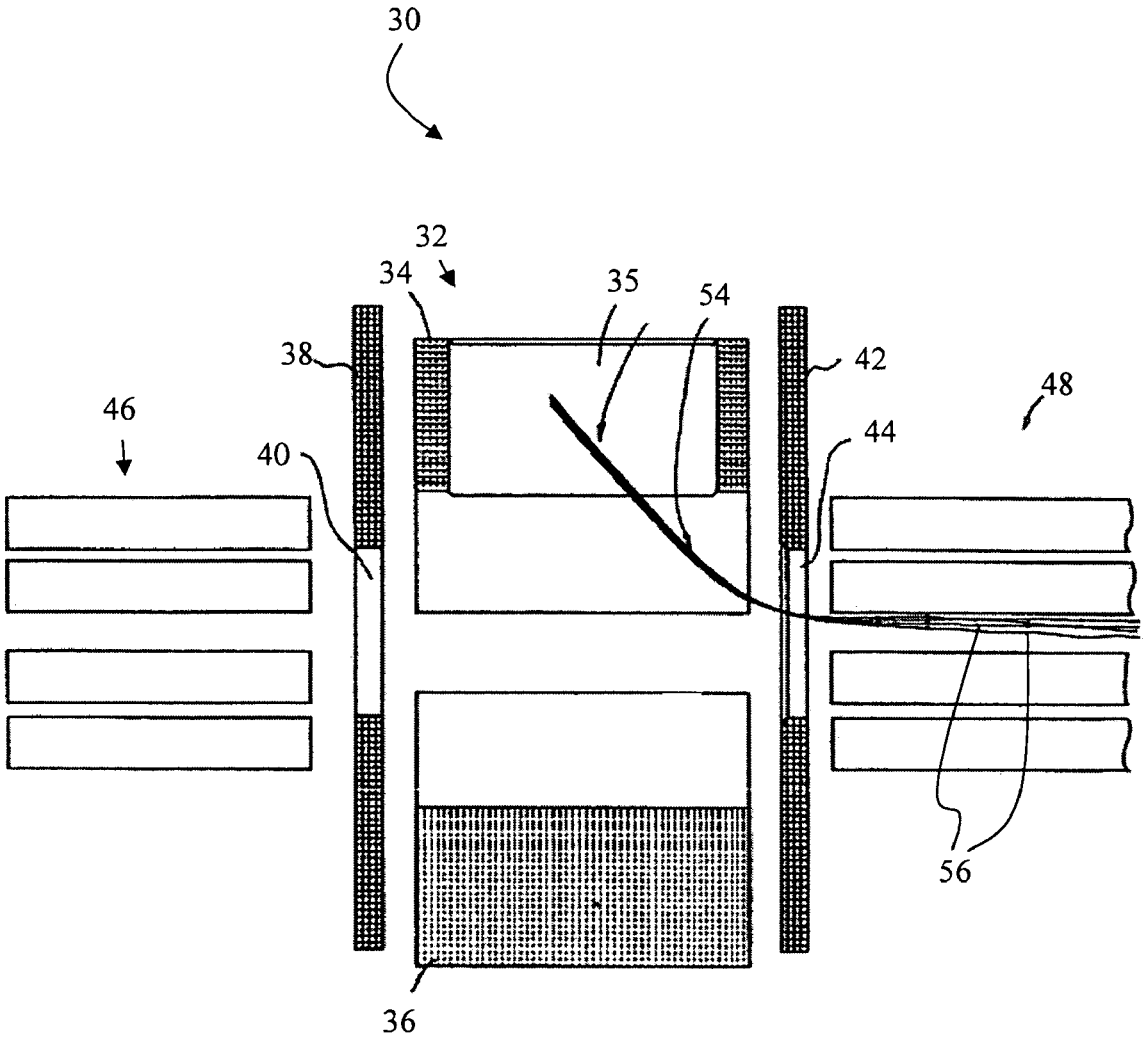
FIG. 3 is a schematic representation of a second representative embodiment of a subject device operated in the "on" mode. Simulated trajectories for the second ion beam passing through the secondary ion passageway and merging with the primary ion path are shown.

As illustrated in FIGS. 2 and 3, the subject electrical lens may be generally operated in two modes with respect to the second ion beam, an "off" mode in which there is no voltage differential between the first and second parts of the lens (i.e., a voltage of the same magnitude and polarity is applied to the first and second parts of the lens), and an "on" mode in which a voltage differential exists between the first and second parts of the lens (i.e., different and/or opposite polarity voltages are applied to the first and second parts of the lens). As illustrated in FIG. 2, in the "off" mode, a primary ion stream enters and exits the primary ion passageway. As illustrated in FIG. 3, in the "on" mode, a secondary ion stream enters the subject electrical lens via the secondary ion passageway, and the voltage differential applied the first and second parts of the lens changes the direction of the secondary ion stream and allows it to exit the device via the ion exit of the primary ion passageway.

In use of a subject device, the device may be switched between the "off" mode and the "on" mode in order to introduce ions of the second ion beam into the primary ion path. In certain embodiments, the device may be switched back and forth from the "on" to the "off" modes to facilitate introduction of ions of the second ions beam into the primary ion path. The rate of switching may vary greatly, however, in certain embodiments, a switching rate in the range of about $10^{-1}$ Hz to about $10^{7}$ Hz, e.g., in the range of about $10^{1}$ Hz to about $10^{4}$ Hz, about $10^{4}$ Hz to about $10^{5}$ Hz, about $10^{5}$ Hz to about $10^{6}$ Hz or $10^{6}$ Hz to about $10^{7}$ Hz may be employed. The period of time in which a subject device is in the "on" mode does not necessarily have to be the same as the period of time in which is in the "off" mode. For example, the period of time in which a subject device is "on" may be longer or shorter than the period of time in which is a subject device is "off". In certain embodiments, a subject lens may simply be switched from "on" to "off" or "off" to "on" at an arbitrarily selected time in order to introduce ions of the second beam into the primary ion path.

The magnitude and polarity of the DC voltages employed in a subject device may generally depend on the energy and/or the charge of ions in the primary and secondary ion beams and, as such, may also vary greatly. However, such voltages are readily calculated. In the "off" mode and in certain embodiments, the DC voltages applied to the first and second parts of a subject lens are of the same magnitude and polarity (either positive or negative), and may in the range of about 0 V to about 500 V (e.g., about 5 V to about 20 V, e.g., about 10 V to about 15 V). In the "on" mode and in certain embodiments, the DC voltages applied to the first and second parts of subject lens are of the same magnitude but are of a opposite polarity. In other words, the first or the second part of the lens is held at a voltage that is positive, while the other part of the lens is held at a voltage that is negative. The voltage differential should be sufficient to direct the ions of the second ion beam into the primary ion path. This voltage differential may vary greatly, but is readily calculable. In certain embodiments, the differential voltage employed in a subject lens is in the range of 10 V and 500 V or more, e.g., in the range of about 10 V to about 20 V, about 20 V to about 50 V, about 50 V to about 100 V, about 100 V to about 200 V, about 200 V to about 300 V, about 300 V to about 400 V, about 400 V to about 500 V, or more). In an exemplary embodiment, the first part of the lens is supplied with a DC voltage in the range of about +30 V to about +500 V, and the second part of the lens is supplied with a DC voltage of the same size, but of different polarity, i.e., in the range of about −30 V to about −500 V. In other words, in the "on" mode the instant lens operates as a dipole, i.e., contains a pair of spaced elements having voltage potentials of equal magnitude but of opposite polarity.

Likewise, the voltages applied to the first and second ion stream focusing elements may vary depending on the mass and energy of the ions, and may change in switching a subject device between the "on" and "off" modes. Like the voltages employed in the electrical lens described above, the voltages employed in the first and second ion stream focusing elements are readily calculable. In certain embodiments, each of the ion stream focusing elements may have a voltage in the range of about 1 V to about 50 V, e.g., in the range of about 3 V to about 20 V or about 4 to about 15 V. The voltages applied to the ion stream focusing elements may be changed in switching the device from one mode to another.

FIGS. 2 and 3 schematically illustrate cross-sections of a representative ion delivery device of the invention, in the "off" and "on" modes, respectively. FIGS. 2 and 3 illustrate an ion delivery device 30 in the "off" mode (FIG. 2) or in the "on" mode (FIG. 3) containing a subject electrical lens 32 having a first part 34 and a second part 36. The first and second parts, together, define primary ion passageway 37 and the secondary ion passageway 35 is contained in the first part 34 of the electrical lens. The ion delivery device 30 also contains a first ion stream focusing device 38 containing an aperture 40 for focusing primary ions to the ion entrance of the primary ion passageway 37, and a second ion stream focusing device 42 containing an aperture 44 for focusing primary ions and/or the ions of the second ion beam as they exit the primary ion passageway. In the embodiments shown in FIGS. 2 and 3, the ion delivery device contains a first multipole device 46 and a second multipole device 48 and is arranged so that the subject lens is between the first and second multipole devices.

FIG. 2 shows simulated trajectories 50 of a primary ion stream through a subject ion delivery device in the "off" mode. In this simulation, the ions of the simulated primary ion stream 50 have a mass of 1000 Da and have 12 eV of axial energy. The multipole device 48 is employed as an octopole ion guide operated at 3 MHz, 200 pk V RF voltage, and lenses 38 and 42 are set at 6 V DC. The first part 34 and the second part 36 of a subject electrical lens are both set at 10 V DC, and provide efficient ion focusing towards exit aperture 44 and multipole device 48. In this example, the primary ion stream 50 follows the primary ion path, and passes through the first multipole device 46, aperture 40 of first ion stream focusing device 38, primary ion passageway 37, aperture 44 of second ion stream focusing device 42, and enters the second multipole device 48. The ion trajectories 50 are shown with markers 52 spaced in 1 μs time intervals.

FIG. 3 shows simulated trajectories 54 of a secondary ion stream through a subject ion delivery device in the "on" mode. In this simulation, the ions of the secondary ion stream 54 enter the secondary ion passageway at an angle of 45°, have a mass of 1000 Da and have an initial energy of 13.5 eV. The multipole device 48 is employed as an octopole ion guide operated at 3 MHz, 200 pk V RF voltage, and ion stream focusing devices 38 and 42 are set at 6 V DC. The first part 34 of subject electrical lens 32 is set to −60V and the second part 36 of subject electrical lens 32 is set to +60V, providing a voltage differential of 120V between the first and second parts In this mode, the direction of the secondary ion stream bends towards the primary ion path. The secondary ion stream merges with the primary ion path, passes through aperture 44 and enters octopole device 48. Again, the ion trajectories 54 are shown with markers 56 spaced in 1 μs time intervals.

The split lens generally contains more then two elements connected together in a way that provides dipole electric field within the device that is appropriate for merging the second ion beam into the primary ion path. The split lens of the present invention can therefore be of various shapes and should not be limited to those shapes explicitly set forth herein. For example, a subject split lens may be generally tubular in shape or conical in shape. However, a split lens containing two parallel plates instead of cylindrical or conical elements is also envisioned, as well as others.

Figure 4:
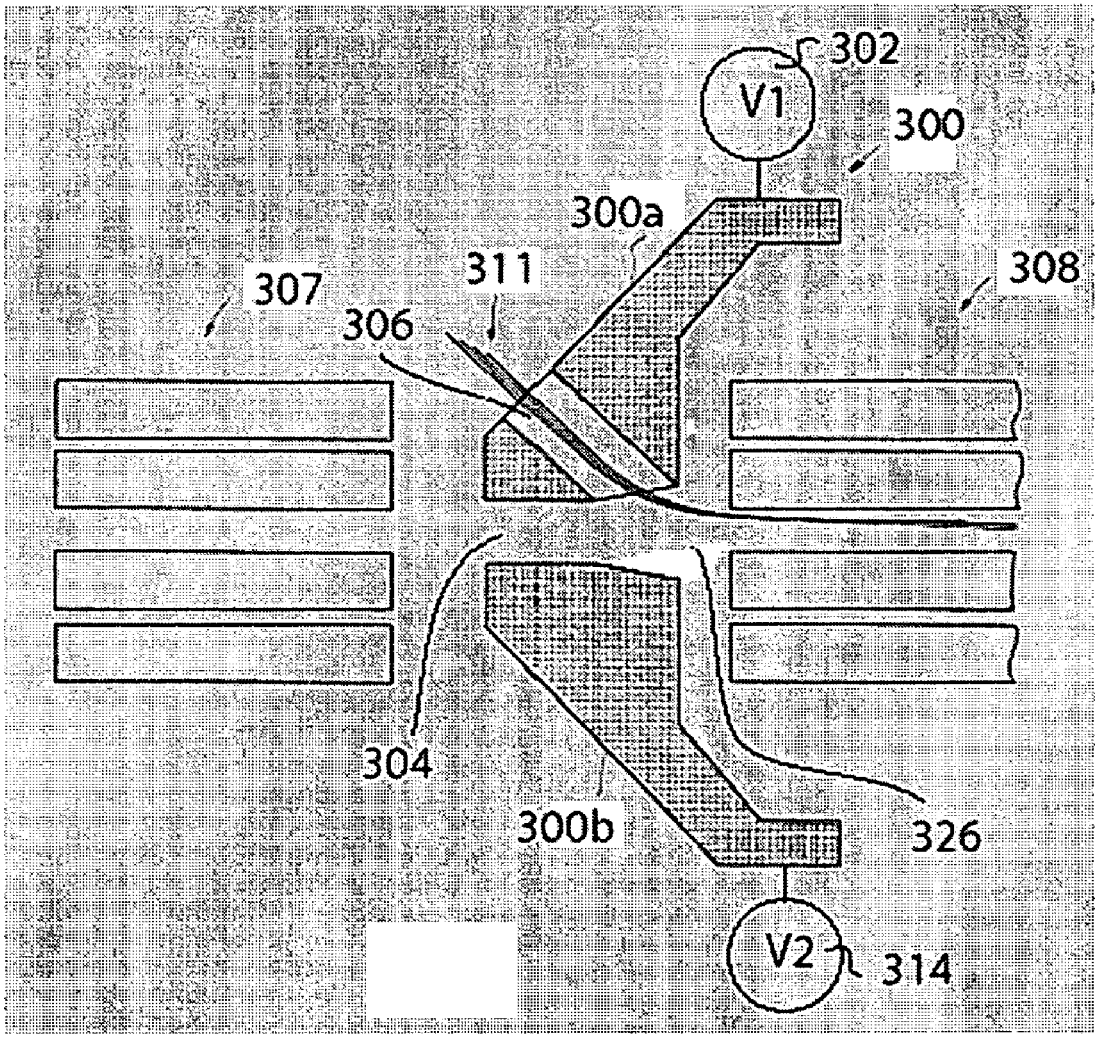
FIG. 4 is a schematic representation of a third representative embodiment of a subject device with conical split lens.

FIG. 4 illustrates a split lens that is conical in shape, i.e., a conical split lens. In certain embodiments and with reference to FIG. 4, an instant lens 300 may be generally conical in shape, having a primary ion passageway 304 that forms part of the primary ion path of a mass spectrometer, and a secondary ion passageway 306. Ions may be confined to the primary ion path by the ion guides 307 and 308. The secondary ion passageway merges with the primary ion passageway within the lens 300. The electrical lens 300 contains a first part 300*a* and a second part 300*b* that, together, form (i.e., define) the primary ion passageway 304. The first part 300*a* may contain the secondary ion passageway 306. The first part may be connected to a first DC power supply 312 and the second part may be connected to a second DC power supply 314. During operation of the subject electrical lens 300, a secondary ion beam, indicated by arrow 311, enters the ion entrance of the secondary ion passageway 306. The secondary ion stream is introduced into the primary ion path within the device and the second ion beam 311 exits the device through the ion exit 326. By applying differential voltage potentials applied to the first part 300*a* and the second part 300*b* by power supplies 302 and 314, respectively, the second ion stream passes through the secondary ion passageway, changes direction, and merges with the primary ion path within the device. Since the lens described herein contains two parts that define the primary ion passageway, the instant lens, in certain embodiments, may be referred to as a conical split lens.

In certain embodiments, the secondary ion stream may be introduced into the secondary ion passageway at the least practical gliding angle (i.e., the smallest practical angle between the primary ion path and the central axis of the primary ion passageway) in order to minimize ion loss and mass discrimination.

In addition to the devices described above, the invention further provides a method of introducing a second ions beam into a primary ion path in a mass spectrometer system. The method employs a subject electrical lens. This method generally involves directing a secondary ion stream into an entrance of a secondary ion passageway of a subject electrical lens containing a primary ion passageway and a secondary ion passageway that merges with the primary ion passageway, and introducing the second ion beam into the primary ion path using the lens.

For example, the instant device may be employed to introduce ions from a second (e.g., auxiliary) ion source into the primary ion path of a mass spectrometer system without significantly compromising the transmission of ions produced by a first ion source (i.e., a primary ion source) down the primary ion path. The instant device also provides a fast (in the order of about 5 is to 100 μs) and highly effective switch that provides for switching between a primary ion stream and a secondary ion stream in the primary ion path in a mass spectrometer system. Using a subject device, the primary ions, the ions of the second ion beam, a combination of primary ions and the ions of the second ion beam, or daughter ions that result from reaction between the primary ions and the ions of the second ion beam may be transported to a mass analyzer and analyzed therein. Further, the subject device may be employed to introduce a second ion beam into an RF-ion guide, a collision/reaction cell, or a two- or three-dimensional RF ion trap, for example, at the gliding or near gliding angle of the primary ion path.

In one embodiment, the subject device may be employed to rapidly switch between a primary ion stream containing ions from a sample of interest and a secondary ion stream containing mass reference standards (i.e., ions of known mass and charge) for the purpose of increasing the accuracy of mass determination of the ions in the primary ion stream. In another embodiment, the system may employ a collision cell/two-dimensional ion trap and time-of-flight mass analyzer arranged in tandem, or, in other embodiments, a collision cell/two-dimensional ion trap and Fourier transfer ion cyclotron (FT-ICR) analyzer arranged in tandem.

The subject device may be employed to combine ions of opposite polarity (i.e., positively and negatively charged ions) in a reaction (e.g., collision) cell by introducing ions of a second ion beam of one polarity into a primary ion path of ions of the other polarity. In this embodiment, introduction of primary and ions of a second ion beam into a reaction cell may cause ion-interactions to enhance fragmentation of ions of interest, or decrease the number of charges on multiply charged ions of interest, for example.

The ion optical system described above provides a rapid switch that can introduce a second ion beam into a primary ion path without significantly reducing the detectability of primary ions traveling down that path. The ion optical system described above may be economically implemented, and only requires the use a relatively small number of additional DC electrodes. Several secondary ion streams may be merged into the primary ion path of a mass spectrometer system using the above-described device, and, in certain embodiments, a subject device provides less cross-contamination, as compared to the means for combining ions found in other systems. Accordingly, the subject invention represents a significant contribution to the mass spectrometry arts.

In accordance with the above, the invention also provides a computer readable medium containing instructions (i.e., programming) for performing this method in a mass spectrometer system. In this embodiment, the term "computer readable medium" refers to any storage or transmission medium that participates in providing instructions and/or data to a computer for execution and/or processing. Examples of storage media include floppy disks, magnetic tape, CD-ROM, a hard disk drive, a ROM or integrated circuit, a magneto-optical disk, or a computer readable card such as a PCMCIA or Flash card and the like, whether or not such devices are internal or external to the computer. A file containing information may be "stored" on computer readable medium, where "storing" means recording information such that it is accessible and retrievable at a later date by a computer.

With respect to computer readable media, "permanent memory" refers to memory that is permanent. Permanent memory is not erased by termination of the electrical supply to a computer or processor. Computer hard-drive ROM (i.e. ROM not used as virtual memory), CD-ROM, floppy disk and DVD are all examples of permanent memory. Random Access Memory (RAM) is an example of non-permanent memory. A file in permanent memory may be editable and re-writable. The subject device described in great detail above may be employed in a variety of different ways in a mass spectrometer system.

In one embodiment, the instructions control the voltages applied to the subject electrical lens, and any associated focusing lenses, for example. By providing these instructions, the program will ultimately control the entrance of ions to the primary and secondary ion passageways of the electric lens.

Mass Spectrometry Systems

The subject device may be employed in a variety of mass spectrometry systems that generally contain at least two ion sources, e.g., a first ion source and a second ion source, and a mass analyzer, in addition to the above-described electrical lens.

Figure 5:
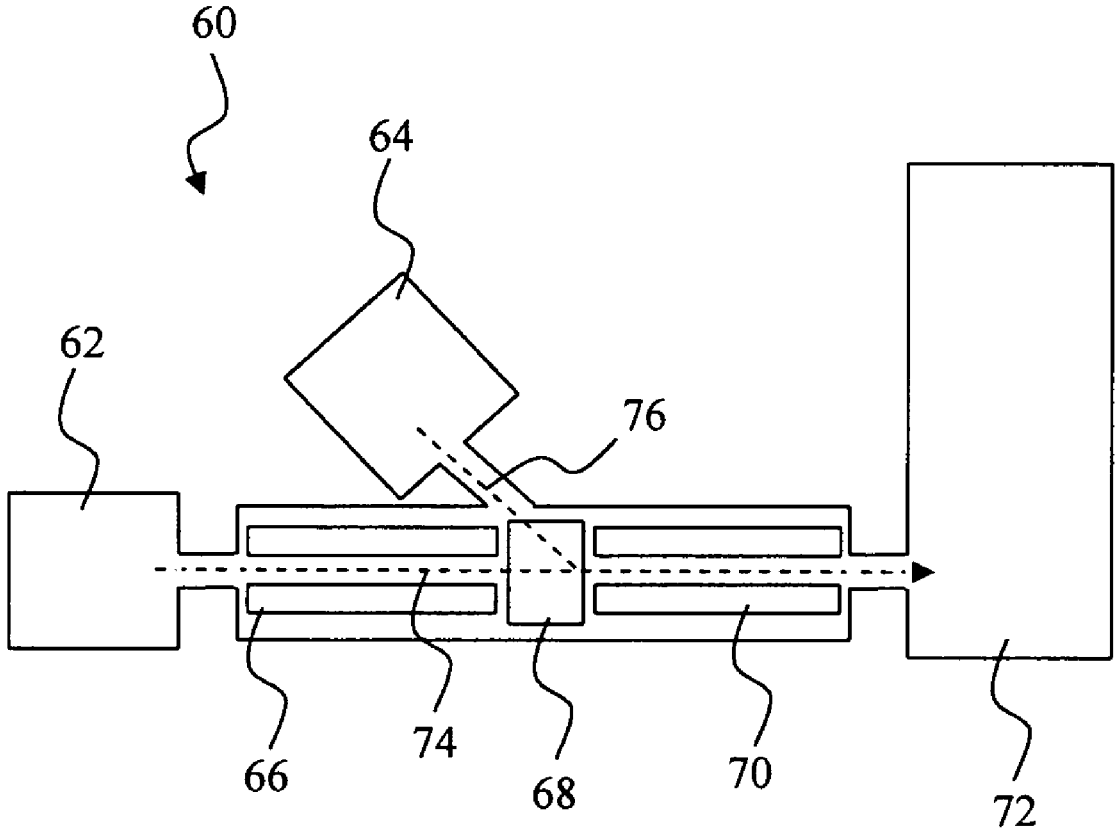
FIG. 5 is a schematic representation of a first representative embodiment of mass spectrometry system containing a subject device.

A representative embodiment of a subject mass spectrometer system is shown in FIG. 5. With reference to FIG. 5, a representative mass spectrometer system 60 of the invention may include a first ion source 62 and a second ion source 64, a subject ion delivery device (containing a first multipole device 66, a subject electrical lens 68 and a second multipole device 70) and a mass analyzer 72. Certain optional elements, e.g., vacuum pumps, power supplies, intermediate vacuum stages, skimmers, ion optics, other multipole devices, ion pursers, etc., are not shown in FIG. 5, although such elements are well known in the mass spectrometry arts and are readily employed herein. For example, an ion transport element, e.g., a multipole ion guide, may be employed to transport ions from the second ion source 64 to the entrance of the secondary ion passageway of device 68. Also shown in FIG. 5 is the primary ion path 74 of this representative mass spectrometry system, as well as the path of ions produced by the second ion source. The subject system is readily adapted (for example, by adding a plurality of subject electrical lenses) to introduce a plurality of secondary ion streams into a primary ion path in a mass spectrometry system.

The ion sources 62 and 64 may be any source of ions and may provide positively-charged ions or negatively-charged ions. For example, any of the ion sources may be a glow discharge ion source, a laser desorption/ionization ion source, a field ionization ion source, a thermal ionization ion source, a chemical ionization ion source or a photo-ionization ion source. In one embodiment, therefore, either of the ion sources may be an electrospray device that provides positive or negative ions. Such sources of charged particles are generally well known in the art, and are readily adapted for use herein without undue effort.

Figure 6:
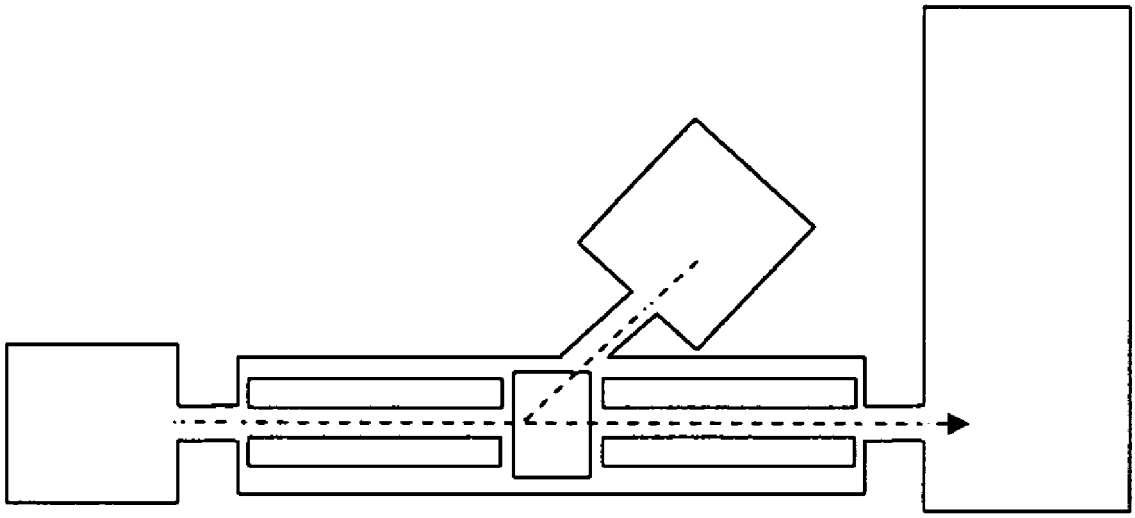
FIG. 6 is a schematic representation a of a second representative embodiment mass spectrometry system containing a subject device.

In a related embodiment, the second ion beam can enter the primary ion path not in the direction of the mass analyzer (as shown in FIG. 5), but rather in the direction of the primary ion source. This embodiment is schematically illustrated in FIG. 6. In this embodiment, after the ions of the second ion beam have merged with the primary ion path, they travel towards the primary ion source, in a direction that is contrary to the direction that the primary ions usually travel to the mass analyzer. The merged ions from the second ion beam turn around within the main ion path (e.g., within the multipole device 66) and travel back toward to the mass analyzer. This embodiment may be especially beneficial for combining mass calibrant ions for detection in a TOF mass analyzer. Since ions of the second ion beam would travel first into a relatively high pressure ion optics region, they may receive exactly the same ion energy as the primary ions, thus providing better mass calibrating standards. The components illustrated in FIG. 6 are the identical to those illustrated on FIG. 5.

The subject apparatus may be employed in a variety of mass spectrometry systems that generally contain a primary ion source in addition to the above-described apparatus. The ion source employed in a subject system may be any type of ion source, including, but not limited to a matrix assisted laser desorption ionization source (MALDI) operated in vacuum or at atmospheric pressure (AP-MALDI), an electrospray ionization (ESI) source, a chemical ionization source (CI) operated in vacuum or at atmospheric pressure (APCI), electron ionization ion source (EI) or an inductively coupled plasma (ICP) source, among others. The chemical samples introduced to the ion source may be subjected to a pre-separation with a separation device, such a liquid chromatograph (LC), a gas chromatograph (GC) or an ion mobility spectrometer (IMS).

In certain embodiments, an ion source of a subject mass spectrometer system may be connected to an apparatus for providing a sample containing analytes to the ion source. In certain embodiments, the apparatus is an analytical separation device such as a gas chromatograph (GC) or liquid chromatograph (LC), including a high performance liquid chromatograph (HPLC), a micro- or nano-liquid chromatograph or an ultra high pressure liquid chromatograph (UHPLC) device, a capillary electrophoresis (CE), or a capillary electrophoresis chromatograph (CEC) apparatus, however, any manual or automated injection or dispensing pump system may be used. In particular embodiments, a sample may be provided by means of a nano- or micropump, for example. The first ion source and the second ion sources may be different types of ion sources.

Likewise, the mass analyzer may be any type of suitable mass analyzer. In representative embodiments, the mass analyzer may be a time of flight (TOF) mass analyzer (which term includes reflectron time or flight mass analyzers and other variations thereof), or a Fourier transform ion cyclotron resonance (FT-ICR) mass analyzer or 2D and 3D quadrupole ion trap mass analyzers In one embodiment provided solely to illustrate a representative mass spectrometry system in which a subject device may be employed, the subject apparatus is employed in a tandem mass spectrometer containing a first ion source and a second ion source, a multipole mass selector connected to the first ion source, a subject electrical lens connected to the multipole mass selector via its primary ion passageway and further connected to a second ion source via its secondary ion passageway, a multipole collision cell connected to the ion exit of the subject lens, and a mass analyzer connected to the ion exit end of the multipole collision cell. The system is configured so that ions produced by the second ion source are introduced into primary ion path and transferred into the collision cell where they are combined with ions produced by the first ion source. In the collision cell, the second ion beam ions facilitate fragmentation of the primary ions, and the daughter ions produced by fragmentation of the primary ions are transferred into the mass analyzer where their masses are determined.

In another embodiment provided solely to illustrate a further representative mass spectrometry system in which a subject device may be employed, the subject apparatus is employed in a mass spectrometer containing a first and a second ion source, a multipole ion guide connected to the first ion source, a subject electrical lens connected to the multipole ion guide via its primary ion passageway and further connected to a second ion source via its secondary ion passageway, and a mass analyzer connected to the ion exit end primary ion passsageway. The system is configured so that ions produced by the second ion source are introduced into primary ion path and transferred into the multipole ion guide where they are combined with ions produced by the first ion source. The combined ions are transferred into the mass analyzer where their mass is determined. The second ion beam ions are ions of known m/z and provide a more accurate estimate of the m/z of the primary ions.

In accordance with the above, the invention also provides a method of sample analysis. In general, this method involves ionizing analytes of a sample in an ion source to produce primary ions, employing a subject lens to combine the primary ions with second ion beam ions to produce combined ions, and subjecting said combined ions to mass analysis. In certain embodiments the second ion beam ions may be reference mass standards.

The invention finds general use in methods of sample mass analysis, where a sample may be any material (including solubilized or dissolved solids) or mixture of materials, typically, although not necessarily, dissolved in a solvent. Samples may contain one or more analytes of interest. Samples may be derived from a variety of sources such as from foodstuffs, environmental materials, a biological sample such as tissue or fluid isolated from a subject (e.g., a plant or animal subject), including but not limited to, for example, plasma, serum, spinal fluid, semen, lymph fluid, the external sections of the skin, respiratory, intestinal, and genitourinary tracts, tears, saliva, milk, blood cells, tumors, organs, and also samples of in vitro cell culture constituents (including but not limited to conditioned medium resulting from the growth of cells in cell culture medium, putatively virally infected cells, recombinant cells, and cell components), or any biochemical fraction thereof. Also included by the term "sample" are samples containing calibration standards or reference mass standards.

Components in a sample are termed "analytes" herein. In certain embodiments, the subject methods may be used to investigate a complex sample containing at least about $10^1$, $5\times10^2$, $10^3$, $5\times10^3$, $10^4$, $5\times10^4$, $10^5$, $5\times10^5$, $10^6$, $5\times10^6$, $10^7$, $5\times10^7$, $10^8$, $10^9$, $10^{10}$, $10^{11}$, $10^{12}$ or more species of analyte. The term "analyte" is used herein to refer to a known or unknown component of a sample. In certain embodiments, analytes are biopolymers, e.g., polypeptides or proteins, that can be fragmented into smaller detectable molecules.

All publications and patents cited in this specification are herein incorporated by reference as if each individual publication or patent were specifically and individually indicated to be incorporated by reference. The citation of any publication is for its disclosure prior to the filing date and should not be construed as an admission that the present invention is not entitled to antedate such publication by virtue of prior invention.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

What is claimed is:

1. A device for introducing a second ion beam into a primary ion path, comprising:

an electrical lens comprising:

a) a primary ion passageway; and b) a secondary ion passageway that merges with said primary ion passageway, wherein said electrical lens comprises a first part and a second part that, together, form said primary ion passageway and wherein said first part comprises said secondary ion passageway.

2. The device of claim 1, wherein electrical potentials applied to said first part and said second part allow for ions of a second ion beam to be introduced into a primary ion path extending through said primary ion passageway.

3. The device of claim 2, wherein said electrical potentials cause a change in direction of movement of ions in said second ion beam as they are introduced into said primary ion path.

4. The device of claim 1, wherein said first and second parts are electrically conductive.

5. The device of claim 1, wherein said first and second parts are spaced from each other.

6. The device of claim 1, wherein said first and second parts are each electrically connected to a power supply.

7. The device of claim 1, further comprising ion stream focusing devices at ion exit and ion entrance ends of said primary ion passageway.

8. The device of claim 7, wherein said ion stream focusing devices are ring lenses.

9. A device for delivering ions to a mass analyzer comprising:

an electrical lens comprising a primary ion passageway and a secondary ion passageway that merges with said primary ion passageway, wherein said electrical lens comprises a first part and a second part that, together, form said primary ion passageway and wherein said first part comprises said secondary ion passageway, a first multipole device at an ion entrance of said primary ion passageway; and a second multipole device at an ion exit of said primary ion passageway.

10. The device of claim 9, wherein at least one of said first and second multipole devices is a quadrupole, hexapole or octopole ion guide.

11. The device of claim 10, further comprising a third multipole device for directing a second ion beam towards an ion entrance of said secondary ion passageway.

12. The device of claim 11, wherein said second ion beam is directed towards said ion entrance at an angle of about 5° to about 85° with respect to a central axis of said secondary ion passageway.

13. The device of claim 9, wherein at least one of said first and second multipole devices is an ion trap.

14. The device of claim 9, further comprising ion stream focusing devices at said ion entrance and said ion exit of said primary ion passageway.

15. The device of claim 14, wherein said ion stream focusing devices are focusing lenses.

16. A mass spectrometer system comprising:

an electrical lens comprising a primary ion passageway and a secondary ion passageway that merges with said primary ion passageway, wherein said electrical lens comprises a first part and a second part that, together, form said primary ion passageway and wherein said first part comprises said secondary ion passageway;

a first ion source operably connected to an ion entrance of said primary ion passageway;

a second ion source operably connected to an ion entrance of said secondary ion passageway; and a mass analyzer connected to an ion exit of said primary ion passageway.

17. The mass spectrometer of claim 16, further comprising a multipole ion guide between said electrical lens and said first ion source.

18. The mass spectrometer of claim 17, further comprising an ion stream focusing device between said multipole ion guide and said electrical lens.

19. The mass spectrometer of claim 16, wherein said mass analyzer is a time of flight mass analyzer, a Fourier transform ion cyclotron resonance (FTICR) mass spectrometer, an ion trap mass spectrometer, a quadrupole mass filter or a hybrid thereof.

20. The mass spectrometer of claim 16, wherein at least one of said ion sources is a MALDI, AP-MALDI, FAIMS, API, ESI, APCI, EI or ICP ion source.

21. The mass spectrometer of claim 16, wherein at least one of said ion sources is connected to a liquid chromatography system.

22. A method of introducing a second ion beam into a primary ion path, comprising:

directing a secondary ion beam into an entrance of a secondary ion passageway of an electrical lens comprising a primary ion passageway and said secondary ion passageway, wherein said secondary ion passageway merges with said primary ion passageway, wherein said electrical lens comprises a first part and a second part that, together, form said primary ion passageway and wherein said first part comprises said secondary ion passageway; and introducing said second ion beam into said primary ion path using said electrical lens.

23. The method of claim 22, wherein said second ion beam is introduced into said primary ion path in an area at which said primary ion passageway and said secondary passageway intersect.

24. The method of claim 22, wherein said electrical lens has a first part and a second part that, together, form said primary ion passageway and wherein said first part comprises said secondary ion passageway.

25. The method of claim 24, wherein said second ion beam is introduced by a differential potential supplied to said first part and said second part.

26. A method of sample analysis, comprising:

ionizing analytes of a sample in an ion source to produce primary ions;

employing an electrical lens to combine ions of a second ion beam with said primary ions to produce combined ions, wherein said electrical lens comprising a primary ion passageway and a secondary ion passageway that merges with said primary ion passageway and comprises a first part and a second part that, together, form said primary ion passageway and wherein said first part comprises said secondary ion passageway; and subjecting said combined ions to mass analysis.

27. The method of claim 26, wherein said second ion beam contains reference mass standards.

28. The method of claim 26, wherein said electrical lens is a split lens.

29. The method of claim 28, wherein said split lens comprises at least two lens electrodes, wherein ion transmission through said split lens is controlled by:

a) applying a differential potential to create a dipolar electrical field to facilitate merging of the second ion beam into a primary ion path and b) applying substantially equal potentials to switch off said dipole electrical field and transmit said primary ions along the primary ion path.

30. The method of claim 29, wherein said second ion beam is directed into said lens in the direction of a mass analyzer.

31. The method of claim 29, wherein said second ion beam is directed into said primary ion path in the direction towards said ion source.

32. The method of claim 26, wherein said ions of said second ion beam are of opposite polarity to said primary ions.

* * * * *